US005301989A

United States Patent [19]

Dallmann et al.

[11] Patent Number: 5,301,989

[45] Date of Patent: Apr. 12, 1994

[54] TILT LOCK FOR DOUBLE-HUNG WINDOWS

[75] Inventors: Mary B. Dallmann; Guy C. Stormo, both of Owatonna, Minn.

[73] Assignee: Truth Hardware Corporation, Owatonna, Minn.

[21] Appl. No.: 28,306

[22] Filed: Mar. 9, 1993

[51] Int. Cl.[5] ..... E05C 1/06

[52] U.S. Cl. ..... 292/142; 292/DIG. 31; 292/147; 292/DIG. 38; 292/337

[58] Field of Search ..... 292/142, 147, 152, 172, 292/143, 175, 337, DIG. 38

[56] References Cited

U.S. PATENT DOCUMENTS

| | | | |
|---|---|---|---|
| 374,391 | 12/1887 | Born | 292/142 |
| 2,934,370 | 4/1960 | Love et al. | 292/142 |
| 3,122,797 | 3/1964 | Segre | 292/175 X |
| 3,125,366 | 3/1964 | Cetrone et al. | 292/DIG. 38 X |
| 4,502,716 | 3/1985 | Yu | 292/142 |
| 5,121,951 | 6/1992 | Harbom et al. | 292/175 |
| 5,127,192 | 7/1992 | Cross | 49/181 |
| 5,139,291 | 8/1992 | Schultz | 292/42 |
| 5,159,782 | 11/1992 | Sales | 49/380 |
| 5,165,737 | 11/1992 | Riegelman | 292/42 |
| 5,168,665 | 12/1992 | Goldenberg | 49/172 |

FOREIGN PATENT DOCUMENTS

| | | | |
|---|---|---|---|
| 47905 | 5/1979 | Canada | 292/142 |
| 1260183 | 3/1961 | France | 292/142 |

*Primary Examiner*—Richard E. Moore

*Attorney, Agent, or Firm*—Wood, Phillips, VanSanten, Hoffman & Ertel

[57] ABSTRACT

A latch for selectively connecting a sash of a double-hung window to a slide track in a window frame, including a lever including a gear at one end, a latch housing mountable to the sash, the housing including means for pivotally supporting the lever, and a locking member movable between a locked position securing the sash to the track and an unlocked position releasing the sash from the track. The locking member includes a tongue projecting from the latch housing when the tilt latch is in the locked position and lying within the latch housing when the tilt latch is in the unlocked position, and a rack engaging the lever gear to move the locking member to locked and unlocked positions in response to pivoting of the lever. The lever gear includes a disk formed along one side, and the locking member includes a channel along the rack receiving the disk during pivoting of the lever. A stop is secured to the latch housing, which stop engages the locking member to prevent overpivoting of the lever arm when the lever arm is moved into the unlocked position. A detent is provided including first and second spaced grooves on one of the lower housing and the locking member and a protuberance on the other of the lower housing and the locking member. The housing includes upper and lower housings which are secured together to mount axially aligned pivots extending from opposite sides of the gear in open notches on one or the other housing members.

18 Claims, 2 Drawing Sheets

TILT LOCK FOR DOUBLE-HUNG WINDOWS

BACKGROUND OF THE INVENTION

1. Technical Field

The present invention is directed toward double-hung windows, and more particularly to tilt latches for double-hung windows.

2. Background Art

Double-hung windows include two window sashes typically mounted for vertical movement along adjacent parallel tracks. Traditional double-hung window designs provide poor washability, however, since it is difficult for a person located inside the room to wash the outside of the window pane. To fully wash the outer surface of such windows (which outer surface is the one which is most often in need of cleaning), the person cleaning the window must typically go outside the dwelling. This is not only extremely inconvenient (as the person has to walk significant distances merely to wash both sides of a single window), it can also force a window washer, when trying to wash double-hung windows located at significant heights, to face the undesirable choice of either risking injury by climbing to that height or doing a relatively poor job of washing by merely reaching from a distance with a hose or a special long pole apparatus of some type. Such cleaning is still further complicated where there are screens or storm windows which must be removed prior to washing.

To overcome this problem, tilting latches for double-hung windows have sometimes been provided. Such latches have generally been installed in opposite ends of a top horizontal rail of the upper and lower sash, and typically include a tongue which during normal operation extends out from the side of the sash into the sash track in the window frame to guide the sash for typical vertical movement. The tongue of each latch is retracted in some manner when washing is desired to free the top rail of the sash from the track so that the sash may be suitably pivoted inwardly about pivots guiding the bottom rail of the sash in the track and thereby allow the washer to easily reach the outside surface of the window pane of that sash.

The tongue in many of the prior art latches is commonly biased outwardly into the track by a spring structure or the like, with the tongue retracted inwardly by the washer manually pulling the tongues in toward the center of the top rail against the force of the spring (see, for example, U.S. Pat. No. 5,139,291). However, with such structures, the tongues can be difficult to move, not only due to the spring but also due to binding which can almost inevitably arise over the long period of use of the latches (due to grime which can gum up the latch as well as bending of the tongue which can occur from the stresses arising during normal sliding operation of the tongue in the track). Such problems can cause the person trying to retract the tongues to hurt their hands and, if the tongue is too difficult to move, they may just give up on trying to wash the window entirely and thereby lose the advantage of the latch structure completely.

Further, such tilt latches have typically had an assortment of complex structures which are difficult and time consuming (and therefore costly) to assemble. Still further, such tilt latches have commonly been made of plastic (in part due to cost constraints), with the result being that excessive load applied to the lever arm when unlocking the tilt latch can too easily damage the structure. Also, such latches may not adequately indicate whether they have been properly returned to their extended position after washing, with the possible result being that the window sash could unexpectedly pivot inwardly at some point thereafter, likely breaking with window pane as well as perhaps injuring any person nearby at the time.

Some attempts have also been made to control movement of the tongue by a pivoting lever. While this can aid in retracting the tongue, such latches have nevertheless encountered many of the above described problems (e.g., difficult, time consuming and costly to assemble, inadequately resistant to damage, and susceptible to allowing the window sash to inadvertently be inadequately secured to the track), and have further resulted in other problems. For example, some of these type latches are susceptible to damage in certain conditions of use. Further, latches of this type can have difficulty providing smooth and consistent operation over their long expect life.

The present invention is directed toward overcoming one or more of the problems set forth above.

SUMMARY OF THE INVENTION

In one aspect of the present invention, a latch for selectively connecting a sash of a double-hung window to a slide track in a window frame is provided, including a lever including a gear at one end, a latch housing mountable to the sash, the housing including means for pivotally supporting the lever, and a locking member movable between a locked position securing the sash to the track and an unlocked position releasing the sash from the truck. The locking member includes a tongue projecting from the latch housing when the tilt latch is in the locked position and lying within the latch housing when the tilt latch is in the unlocked position, and a rack engaging the lever gear to move the locking member to locked and unlocked positions in response to pivoting of the lever.

In another aspect of the present invention, the lever gear includes a disk formed along one side, and the locking member includes a channel along the rack receiving the disk during pivoting of the lever.

In still another aspect of the present invention, the lock includes a stop secured to the latch housing, which stop engages the locking member to prevent overpivoting of the lever arm when the lever arm is moved into the unlocked position. In a preferred embodiment of this aspect of the invention, the locking member includes a longitudinal groove defining a fork and receiving the stop therein. The stop engages the end of the groove at selected limits of movement of the locking member to prevent overpivoting of the lever.

In yet another aspect of the present invention, a detent is provided including first and second spaced grooves on one of the lower housing and the locking member and a protuberance on the other of the lower housing and the locking member.

Another aspect of the present invention is the inclusion of upper and lower housings which may be readily secured together to easily mount axially aligned pivots extending from opposite sides of the gear. In one preferred embodiment, upwardly open notches are provided on the lower housing, and the upper housing secures the lever pivots on the notches for pivoting thereon. In another preferred embodiment, downwardly open notches are provided on opposite sides of the upper housing, and the lower housing retains the locking member within the housing and secures the lever pivots in the notches for pivoting therein.

It is an object of the invention to provide a tilt lock which is easy and inexpensive to manufacture, handle and install.

It is another object of the invention to provide a tilt lock which will operate smoothly, reliably and safely over the long expected useful life of the windows in which they are installed.

DESCRIPTION OF THE PREFERRED EMBODIMENT

Figure 1:
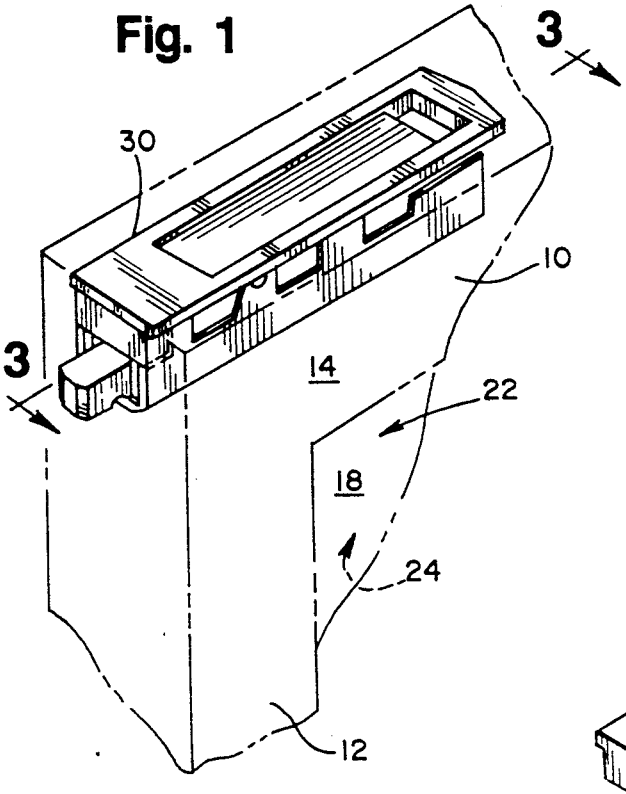
FIG. 1 is a perspective view of a first embodiment of a tilt latch of the present invention mounted in a sash of a double-hung window.

FIG. 1 shows horizontal and vertical rails 10 and 12 of a sash 14 of a double-hung window. The sash 14 supports a window pane 18 having inwardly and outwardly facing surfaces 22 and 24.

Mounted in the horizontal rail 10 of the sash 14 is a tilt latch 30 shown in a locked position. Another tilt latch 30 (not shown) is mounted in an opposite end of the horizontal rail 10. Unlocking both tilt latches 30, as described in detail below, allows the sash 14 of the double-hung window to be tilted inwardly (about suitable pivots on the bottom rail of the sash 14) to allow the outwardly facing surface 24 of the window pane 18 to be easily and safely washed.

Figure 2:
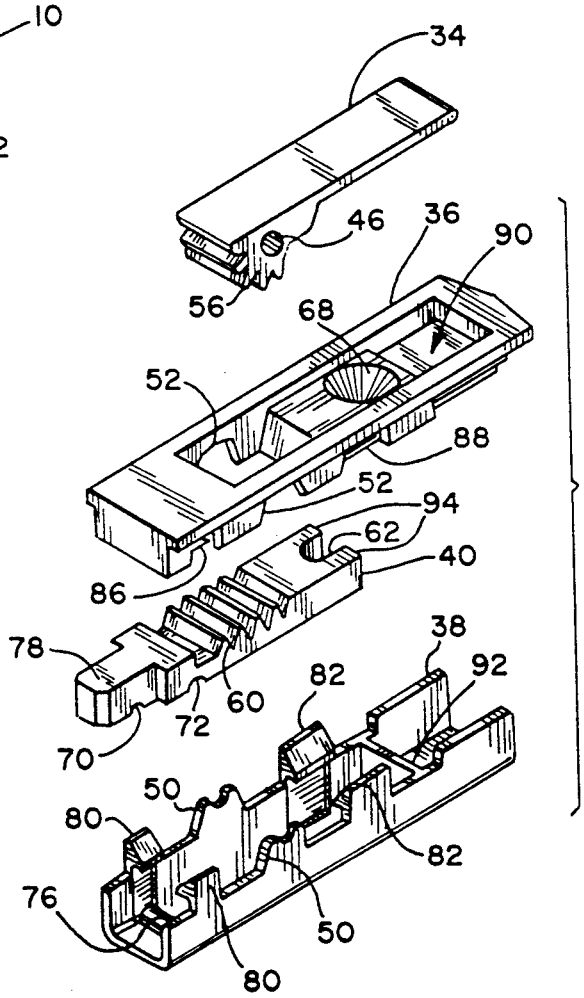
FIG. 2 is an exploded assembly view of the tilt latch of FIG. 1.

A preferred embodiment of the locking tilt latch 30 of the present invention is shown disassembled in FIG. 2 and includes a lever arm 34, an upper housing 36, a lower housing 38, and a locking member 40. During assembly, the lever 34 is placed between the locking member 40 and the upper housing 36 to provide for easy assembly as described in greater detail below.

A pivot 46 on opposite sides of the lever 34 (only one is seen in FIG. 2) is rotatably supported on brackets 50 defining upwardly open notches on the lower housing 40. Recesses 52 on the upper housing 36 engage the brackets 50 when the tilt latch 30 is assembled to retain the lever 34 on the brackets 50 for pivoting.

Figure 3:
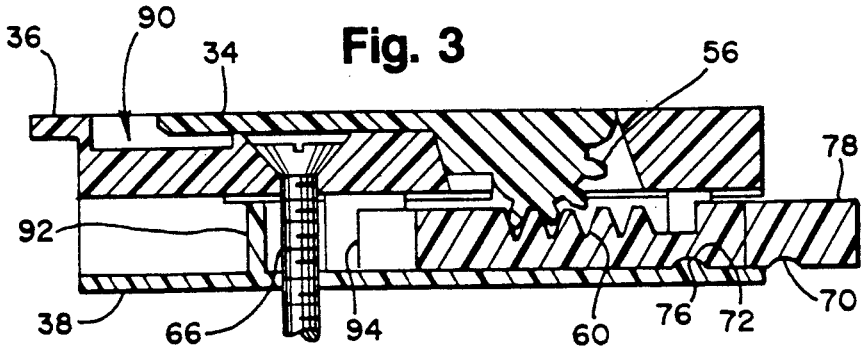
FIG. 3 is a cross-sectional view of the tilt latch taken along line 3—3 in FIG. 1.

A gear 56 formed at an end of the lever 34 engages a rack 60 on the locking member 40. A longitudinally extending vertical groove defines a fork 62 at an end of the locking member 40 to provide clearance for a screw 66 (FIG. 3) which fastens the tilt latch 30 to the sash 14. The screw 66 is countersunk in a conical section 68 formed in the upper housing 36. A vertical detent is provided between the locking member 40 and the lower housing 38 to fix the locking member in the locked and unlocked positions. The detent includes lateral grooves 70 and 72 on a bottom surface of the locking member 40 which engage an upwardly facing protuberance or detent 76 on the lower housing 38 to provide a positive feel when the latch 30 is properly positioned in either its locked or unlocked positions. The detent also secures the latch 30 in either position to prevent the latch 30 from inadvertently changing position, a particular problem when the locking member 40 is retracted during washing, as an attempt to then reattach the sash 10 to the frame could result in inadvertent damage to the frame and/or latch 30.

A tongue 78 projecting from the locking member 40 is received in a track in the window frame when the tilt latch 30 is in the locked position. The tongue 78 is located inside the upper and lower housings 36 and 38 when the tilt latch 30 is in the unlocked position.

A first and second pair of projections 80 and 82 on the lower housing 38 snap-fit into grooves 86 and 88 on the upper housing 36 to easily secure the upper and lower housings together. Thus, assembly of this latch 30 is extremely simple and inexpensive inasmuch as the lever 34 is simply extended through the upper housing 36 from the bottom, its pivots 46 then placed on the lower housing brackets 50 having the locking member 40 therein, and the two upper and lower housings 36, 38 then simply snapped together.

An opening 90 on the upper housing 36 allows a user to grasp an end of the lever 34 with a finger. A transverse wall 92 in the lower housing 38 abuts ends 94 of the fork 62 to prevent further movement of the lever 34 and the locking member 40 toward the unlocked position.

Operation of the latch 30 is as follows. As the user pulls on the lever 34 by inserting a finger in the opening 90, the lever 34 rotates on the lever pivot 46 and the lever gear 56 meshes with the rack 60 to pull the locking member 40 in (to the left in FIG. 3), initially releasing the groove 72 from the protuberance 76. As the user continues pulling on the lever 34, the locking member 40 slides further toward the transverse wall 92, retracting the tongue 78 into the housing. At the end of travel, the groove 70 engages the protuberance 76 (providing a positive feel that the proper position has been reached) and the transverse wall 92 stops the ends 94 of the fork 62 (the fork 62 providing clearance for the mounting screw 66). In this unlocked position, the projecting tongue 78 is located within the upper and lower housings 36, 38 and clear of the track in the window frame so that the sash 14 may be tilted inwardly for cleaning the outwardly facing surface 24 of the window pane 18. Further, the engagement of the groove 70 and protuberance 76 acts as a detent to hold the latch 30 in this position, so that it will not undesirably fall into the locking position when the sash 14 is free of the frame (thereby avoiding the potential of damage to the frame or tongue 78 when the sash 14 is thereafter pivoted back into its normal operating position).

As can be appreciated from the foregoing description, the tilt lock 30 has a simple two-piece housing construction which is easy to manufacture. The upper and lower housing 36 can be casted from zinc. The lower housing 38 and locking member 40 are preferably made of plastic to allow for the flexibility required with the detent structures. The detent including the protuberance 76 and the first and second grooves 70 and 72 holds the tilt latch 30 in the locked or unlocked position and provides feedback to the user by giving a positive feel when the tilt lock 30 is fully in the unlocked and locked positions. The transverse wall 92 prevents the lever 34 from being overpivoted which could damage the rack 60, the lever gear 56 or other parts of the tilt latch 30. The snap-fit upper and lower housings 36, 38 prevent parts of the tilt latch 30 from being lost before installation in the lower sash.

Figure 4:
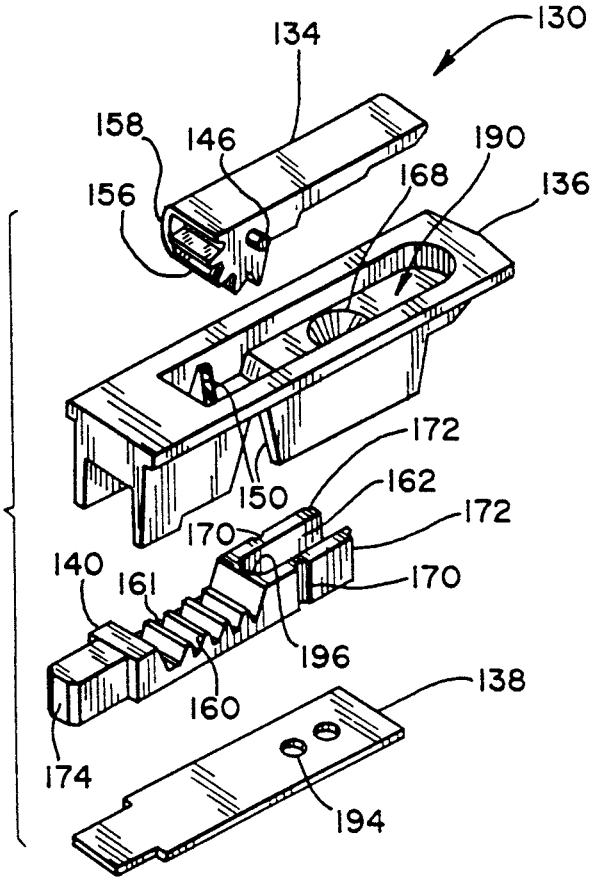
FIG. 4 is an exploded assembly view of a second embodiment of the tilt latch of the present invention.
Figure 5:
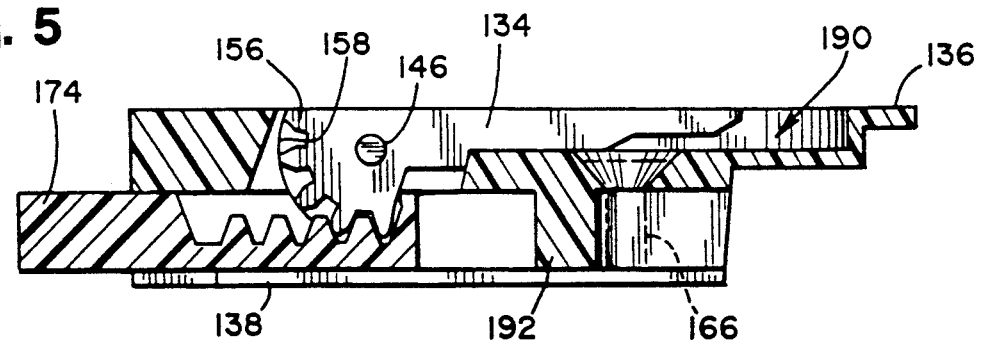
FIG. 5 is a cross-sectional view similar to FIG. 3 but of the tilt latch embodiment shown in FIG. 4.
Figure 6:
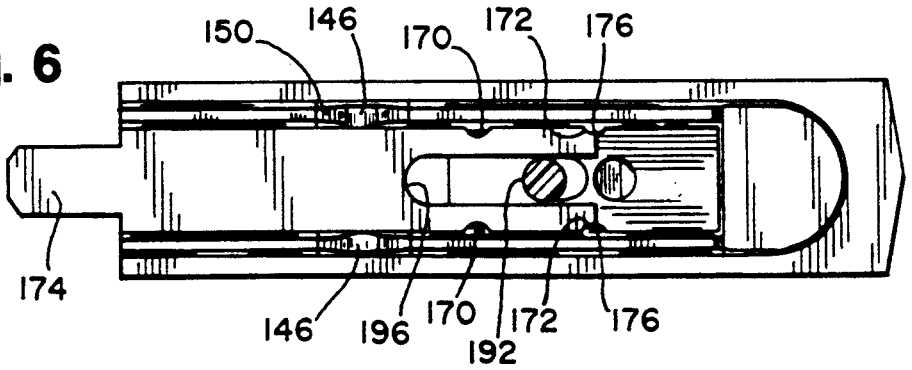
FIG. 6 is a bottom view of the latch embodiment shown in FIG. 4, with the bottom plate removed.

An alternate locking tilt latch 130 is shown in FIGS. 4–6 and includes a lever 134, an upper housing 136, a lower plate 138, and a locking member 140.

During assembly, the lever 134 is placed between the locking member 140 and the upper housing 136. Lever pivots 146 extending from opposite sides of the lever 134 (only one is seen in FIG. 4) are rotatably supported in a pair of notches 150 in the sides of the upper housing 136 which therefore define the axis of pivoting of the lever 134. That is, when the lower plate 138 is secured to the upper housing 136, the lever 134 is held up by the locking member 140 so that its pivots 146 are maintained in the upper end of the notches 150. It will be appreciated that the tapered configuration of the notches 150 allows for reliable positioning of the lever 134 during this easy assembly method, as the pivots 146 can reliable be assembled in the notches 150 without any precision handling being required.

A lever gear 156 including a disk 158 along a side thereof is formed at an end of the lever 134 and engages a rack 160 on the locking member 140. A channel 161 is formed along one side of the rack 160 to provide clearance for the disk 158.

The disk 158 formed on the side of the lever gear 156 allows easy trimming of casting excess during manufacture. As a result of using the disk 158, trimming the excess casting needs to be done only around an arcuate edge of the disk 158 rather than the much more labor intensive (and therefore costly) trimming around each of the grooves of the gear 156. Further, the disk 158 and channel 161 provide additional torsional support and stability to the lever 134. (Further, it should be noted that the above described advantages of such a disk can be obtained with other lock structures, including in particular the tilt lock illustrated in FIGS. 1–3 hereof.)

A vertical groove defines a fork 162 at an end of the locking member 140 to provide clearance for a screw 166 (shown with dotted lines in FIG. 5) which fastens the tilt latch 130 to the sash 14. The screw 166 is countersunk in a conical section 168 formed in the upper housing 136. A vertical detent is provided between the locking member 140 and the upper housing 136 to fix the locking member 140 in the locked and unlocked positions. For example, the detent can include first and second pairs of vertical grooves 170, 172 on outwardly facing sides of the locking member 140 which engage vertical protuberances 176 (see FIG. 6) on opposed inside surfaces of the upper housing 136.

A tongue 174 projecting from the locking member 140 is received in a track in the window frame when the tilt latch 130 is in the locked position. The tongue 174 is located inside the upper housing 136 when the tilt latch 130 is in the unlocked position. An opening 190 on the upper housing 136 allows a user to grasp an end of the lever 134 with a finger. A post 192 extends downwardly from the upper housing 136 into a hole 194 in the plate 138. The post 192 can be a rivet which fastens the upper housing 136, the lever 134, the locking member 140, and the lower plate 138 together.

Operation of this second embodiment is thus similar to the first described embodiment, as follows.

The user pulls on the lever 134 by inserting a finger in the opening 190 and then rotating the lever 134 on the lever pivots 146. The engagement of the lever gear 156 and the rack 160 thus pulls the locking member (to the right in FIG. 5), thereby initially releasing the protuberances 176 from the grooves 172.

As the user continues pulling on the lever 134, the locking member 140 slides inwardly toward the post 192. The grooves 170 engage the protuberances 176 just as the post 192 abuts an inner section 196 of the fork 162. Thus, the post 192 serves to prevent the lever 134 from being overpivoted, which could damage the locking member 140 and/or the lever gear 156. In this position, the projecting tongue 174 is located within the upper housing 136 so that the window may be tilted inwardly for cleaning the outwardly facing surface 24.

As can be appreciated from the foregoing description, the second embodiment of the tilt lock 130 also has a simple construction which is easy to manufacture. The simple construction also allows the tilt latch 130 to be die casted, for example, from zinc. The upper housing 136, the lever 134, the locking member 140 and the lower plate can easily be riveted together preventing loss of parts before installation in the sash 14.

The protuberances 176 and the first and second pairs of grooves 170, 172 hold the tilt latch 130 in the locked or unlocked position and provide feedback to the user by giving a positive feel when the tilt lock 130 is in the locked or unlocked position. Prongs of the fork 162 act like a spring and provide an outward force urging the grooves 170, 172 and protuberances 176 together. By having this detent structure engage in a lateral direction between the opposed inside surface of the upper housing 136 and the locking member 140, operation of the detent structure is not dependent upon any biasing of the rack 160 by the lever gear 156. As a result, the force required on the lever 134 to release the detent from either the locked or unlocked position remains consistent and independent of engagement between the gear 156 and teeth of the rack 160.

The post 192 prevents the lever 134 from being overpivoted which could damage the rack 160 on the locking member 140 or the lever gear 156. The notches 150 accurately center the lever pivot 146 with respect to the upper housing 136 during assembly.

It should now be appreciated that the tilt lock of the present invention is easy and inexpensive to manufacture, handle and install. Still further, the tilt lock of the present invention provides numerous operational advantages, all of which contribute to the provision of smooth and reliable operation over the long expected useful life of the windows in which they are installed.

Still other aspects, objects, and advantages of the present invention can be obtained from a study of the specification, the drawings, and the appended claims.

We claim:

1. A latch for selectively connecting a sash of a double-hung window to a slide track in a window frame, comprising:

a latch housing mountable to the sash, said housing defining an upper boundary and a longitudinal channel;

a lever supported by said latch housing for pivoting about an axis, said lever including a gear segment at one end and a lever arm extending generally radially relative to said axis and axially aligned with said gear segment;

a locking member movable in said channel between a locked position securing the sash to the track and an unlocked position releasing the sash from the track, including a tongue projecting from said latch housing when said tilt latch is in the locked position and lying within said latch housing when said tilt latch is in the unlocked position, a longitudinal slot defining a shoulder at one end of the slot, and a rack engaging the lever gear segment to move said locking member to locked and unlocked positions in response to pivoting of the lever, said lever being substantially flush with the housing upper boundary when positioning said locking member in said locked position;

a guide stop secured to said latch housing and extending through said channel, said guide stop guiding said locking member during movement between said locked and unlocked positions, said guide stop further being positioned to engage the shoulder of said locking member before said lever arm passes vertical when said lever is moved into said unlocked position.

2. The tilt latch of claim 1, wherein said latch housing includes:

upper and lower housings; and means for snap-fitting said upper and lower housings together.

3. The tilt latch of claim 2 wherein said guide stop is a post projecting from said upper boundry.

4. The tilt latch of claim 2, further comprising detent means for releasably retaining said locking member in the locked and the unlocked positions wherein said detent means includes first and second spaced grooves on one of said lower housing and said locking member and a protuberance on the other of said lower housing and said locking member.

5. A latch for selectively connecting a sash of a double-hung window to a slide track in a window frame, said latch when selectively disconnecting said window permitting said window to be pivoted from said frame to allow access for washing, comprising:

a latch housing mountable to the sash;

a lever pivotally mounted to said housing and having a gear at one end, said gear having a disk formed along one side thereof;

a locking member movable between a locked position securing the sash to the track and an unlocked position releasing the sash from the track, including a tongue projecting from said latch housing when said tilt latch is in the locked position and lying within said latch housing when said tilt latch is in the unlocked position, a rack engaging the lever gear to move said locking member to locked and unlocked positions in response to pivoting of the lever, and a channel along said rack, said channel receiving said disk during pivoting of said lever; and a stop secured to said latch housing and engaging said locking member to limit movement thereof.

6. The tilt latch of claim 5 wherein said locking member includes a longitudinal groove defining a fork and receiving the stop therein, said stop engaging the end of said groove at selected limits of movement of said locking member to prevent overpivoting of said lever when said lever is moved into said unlocked position.

7. The tilt latch of claim 5, further comprising detent means including first and second spaced grooves on one of said lower housing and said locking member and a protuberance on the other of said lower housing and said locking member.

8. The tilt latch of claim 7, wherein said stop comprises a post in said housing and received in a longitudinal slot in said locking member, said post abutting an end of said slot when said tilt latch is in said unlocked position.

9. The tilt latch of claim 5, wherein said latch housing includes:

upper and lower housings; and means for snap-fitting said upper and lower housings together.

10. The tilt latch of claim 9, wherein:

said lever includes axially aligned pivots extending from opposite sides of said gear; and said supporting means comprises upwardly open notches on the lower housing, said upper housing securing said lever pivots on said notches for pivoting thereon.

11. The tilt latch of claim 5, wherein:

said latch housing includes an upper housing, a bottom plate, and means for securing said upper housing and bottom plate together;

said lever includes axially aligned pivots extending from opposite sides of said gear; and said supporting means comprises downwardly open notches on opposite sides of the upper housing, said bottom plate retaining said locking member within said housing and securing said lever pivots in said notches for pivoting therein.

12. A latch for selectively connecting a sash of a double-hung window to a slide track in a window frame, said latch when selectively disconnecting said window permitting said window to be pivoted from said frame to allow access for washing, comprising:

a latch housing mountable to the sash;

a lever pivotally mounted to said housing and having a gear at one end, said gear having a disk formed along one side thereof;

a locking member movable between a locked position securing the sash to the track and an unlocked position releasing the sash from the track, including a tongue projecting from said latch housing when said tilt latch is in the locked position and lying within said latch housing when said tilt latch is in the unlocked position, a rack engaging the lever gear to move said locking member to locked and unlocked positions in response to pivoting of the lever, and a channel along said rack, said channel receiving said disk during pivoting of said lever;

a stop secured to said latch housing, said stop engaging said locking member to prevent overpivoting of said lever when said lever is moved into said unlocked position; and detent means for releasably retaining said locking member in the locked and the unlocked positions, said detent means including first and second spaced grooves on one of said lower housing and said locking member and a protuberance on the other of said lower housing and said locking member.

13. The tilt latch of claim 12, wherein said stop comprises a post in said housing and received in a longitudinal slot in said locking member, said post abutting an end of said slot when said tilt latch is in said unlocked position.

14. The tilt latch of claim 12, wherein said locking member includes a longitudinal groove defining a fork and receiving the stop therein, said stop engaging the end of said groove at selected limits of movement of said locking member to prevent overpivoting of said lever when said lever is moved into said unlocked position.

15. The tilt latch of claim 12, wherein said latch housing includes:

upper and lower housings; and means for snap-fitting said upper and lower housings together.

16. The tilt latch of claim 15, wherein:

said lever includes axially aligned pivots extending from opposite sides of said gear; and said supporting means comprises upwardly open notches on the lower housing, said upper housing securing said lever pivots on said notches for pivoting thereon.

17. The tilt latch of claim 15, wherein:

said latch housing includes an upper housing, a bottom plate, and means for securing said upper housing and bottom plate together;

said lever includes axially aligned pivots extending from opposite sides of said gear; and said supporting means comprises downwardly open notches on opposite sides of the upper housing, said bottom plate retaining said locking member within said housing and securing said lever pivots in said notches for pivoting therein.

18. A latch for selectively connecting a sash of a double-hung window to a slide track in a window frame, comprising:

a lever including a gear segment at one end and a lever arm extending generally radially from a pivot axis and axially aligned with said gear;

pivot pins extending from opposite sides of said gear segment and aligned with said pivot axis;

a latch housing mountable to the sash and including upper and lower housing sections, one of said housing sections having sides disposed on opposite sides of a channel and including notches tapered from an apex and open toward said other housing section for receiving said lever pivot pins;

a locking member movable in said latch housing channel between a locked position securing the sash to the track and an unlocked position releasing the sash from the track, said locking member including a tongue projecting from said latch housing when said tilt latch is in the locked position and lying within said latch housing when said tilt latch is in the unlocked position, and a rack engaging the lever gear segment to move said locking member to locked and unlocked positions in response to pivoting of the lever; and means for securing the other housing section to said one housing section with said locking member movable in said channel and said pivot pins secured at substantially the apex of said notches.

* * * * *